United States Patent [19]

Blumberg et al.

[11] Patent Number: 5,025,426

[45] Date of Patent: Jun. 18, 1991

[54] REMINDER APPARATUS

[75] Inventors: Shlomo Blumberg; Avraham Olti, both of Carmiel, Israel

[73] Assignee: Y. M. Shoval Ltd., Haifa, Israel

[21] Appl. No.: 545,804

[22] Filed: Jun. 29, 1990

[30] Foreign Application Priority Data

Nov. 18, 1987 [IL] Israel ..... 84520

[51] Int. Cl.[5] ..... G04B 47/00; E05B 39/04

[52] U.S. Cl. ..... 368/10; 368/62; 70/434; 340/539; 340/542

[58] Field of Search ..... 368/10, 1, 6, 9; 340/539

[56] References Cited

U.S. PATENT DOCUMENTS

| | | | |
|---|---|---|---|
| 4,641,125 | 2/1987 | Pesa | 368/10 |
| 4,675,566 | 6/1987 | Narcisse | 340/539 |
| 4,769,765 | 9/1988 | Green | 368/10 |
| 4,785,291 | 11/1988 | Hawthorne | 340/539 |
| 4,924,206 | 5/1990 | Ayers | 340/539 |
| 4,945,341 | 7/1990 | Buttimer | 340/539 |

*Primary Examiner*—Vit W. Miska

*Attorney, Agent, or Firm*—Benjamin J. Barish

[57] ABSTRACT

Reminder apparatus to be carried by a user with a key constructed to remind the user as to the last operation in which the key was used with respect to a lock. The key includes an operation sensor which stores the time of the last key operation, and a display which, upon manual operation of the key, displays the time of the last key operation.

17 Claims, 4 Drawing Sheets

REMINDER APPARATUS

BACKGROUND OF THE INVENTION

The present invention relates to reminder apparatus for reminding the user as to a certain existing condition. Illustrative applications of the invention, as described below, are to remind the user whether and when he or she has locked a particular lock, and whether he or she has inadvertently moved greater than a predetermined distance from an unlocked door or another device to be secured by the user, such as a portable object being guarded by the user.

People frequently forget whether or not they have properly locked a door or similar device. This can be very troubling and may even require the person to return to see whether or not he or she actually did lock the door. In addition, a person may intentionally leave a door unlocked when the person is in the immediate vicinity, intending to lock the door should he or she move away from the immediate vicinity, but forgets to do so. Further, persons sometimes carrying portable objects, such as a briefcase containing valuables, may inadvertently wander away from the object.

An object of the present invention is to provide reminder apparatus for any of the above applications. A particular object of the invention is to provide reminder apparatus which enables the user to determine the time and nature of the last operation in which a key was used with respect to a lock, i.e., whether the key opened the lock or closed it. Another object of the invention is to provide reminder apparatus which provides an audible signal should the user move away a predetermined distance from a door while the door is not locked. A still further object of the invention is to provide reminder apparatus which produces an audible signal should a user be separated, voluntarily or involuntarily, from an object, such as a briefcase, guarded by the user.

BRIEF SUMMARY OF THE INVENTION

According to one aspect of the present invention, there is provided reminder apparatus to be carried by a user with a key to remind the user as to the last operation in which the key was used with respect to a lock, comprising: a real time clock for measuring time; an operation sensor for sensing the time of the last key operation in which the key was used with respect to the lock; a memory for storing the time of the last key operation as sensed by the sensor; a display; a manually-operable member; and a control circuit effective, upon manual operation of said latter member, to display in the display the time of the last key operation as stored in the memory.

In the described preferred embodiment, the operator sensor also senses whether the last key operation was a lock-closing operation or a lock-opening operation. The memory also stores information indicating whether the last key operation was a lock-closing operation or a lock-opening operation; and the display also displays an indication of whether the last key operation was a lock-closing operation or a lock-opening operation. Also, the display includes a digital numerical indicator for displaying the time of the last key operation, and a light indicator for indicating whether the last key operation was a lock-closing or a lock-opening operation.

The described reminder apparatus may be incorporated in the key to be carried by the user and to be used for locking and unlocking the lock; altenatively, it could be incorporated in a key holder to be carried by the user with the key to be used for locking and unlocking the lock.

According to another feature of the invention, the lock may be on a door to be locked in the closed position, the apparatus further including a transmitter unit in the vicinity of the door transmitting a signal whenever the door is not in its locked condition; and a receiver unit to be carried with the key; the receiver unit including a receiver for receiving the signal from the transmitter, an audible signalling device, and actuator circuit for actuating the audible signal device when the door is not in its locked condition, and the receiver unit is located more than a predetermined distance from the transmitter unit.

According to a still further aspect of the present invention, there is provided reminder apparatus comprising a transmitter unit adapted to be located in the vicinity of a device to be secured and to transmit a signal; and a receiver unit adapted to be carried by a person securing the device, the receiver unit receiving the signal from the transmitter; an audible signalling device; and circuit means for actuating the audible signalling device when the receiver unit is located more than a predetermined distance from the transmitter.

The device to be secured may be a door to be locked as described above, or may be a portable object, such as briefcase or the like, containing valuables, to be guarded by the user. In the latter case, the transmitter unit is preferably located adjacent the object to be guarded and transmits a coded signal identifying a particular receiver unit, and the receiver unit includes a decoder for decoding the coded signal, and a control circuit for disabling the audible signalling device whenever the receiver receives the coded signal, and for actuating the audible signalling device whenever the receiver ceases to receive the coded signal, thereby alerting the user that he has inadvertently wandered away a predetermined distance from the object being guarded.

As a variation in the latter embodiment of the invention, the audible signalling device can be located with the object being guarded, so that if that object has been snatched, it will actuate the audible signalling device to sound an alarm.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
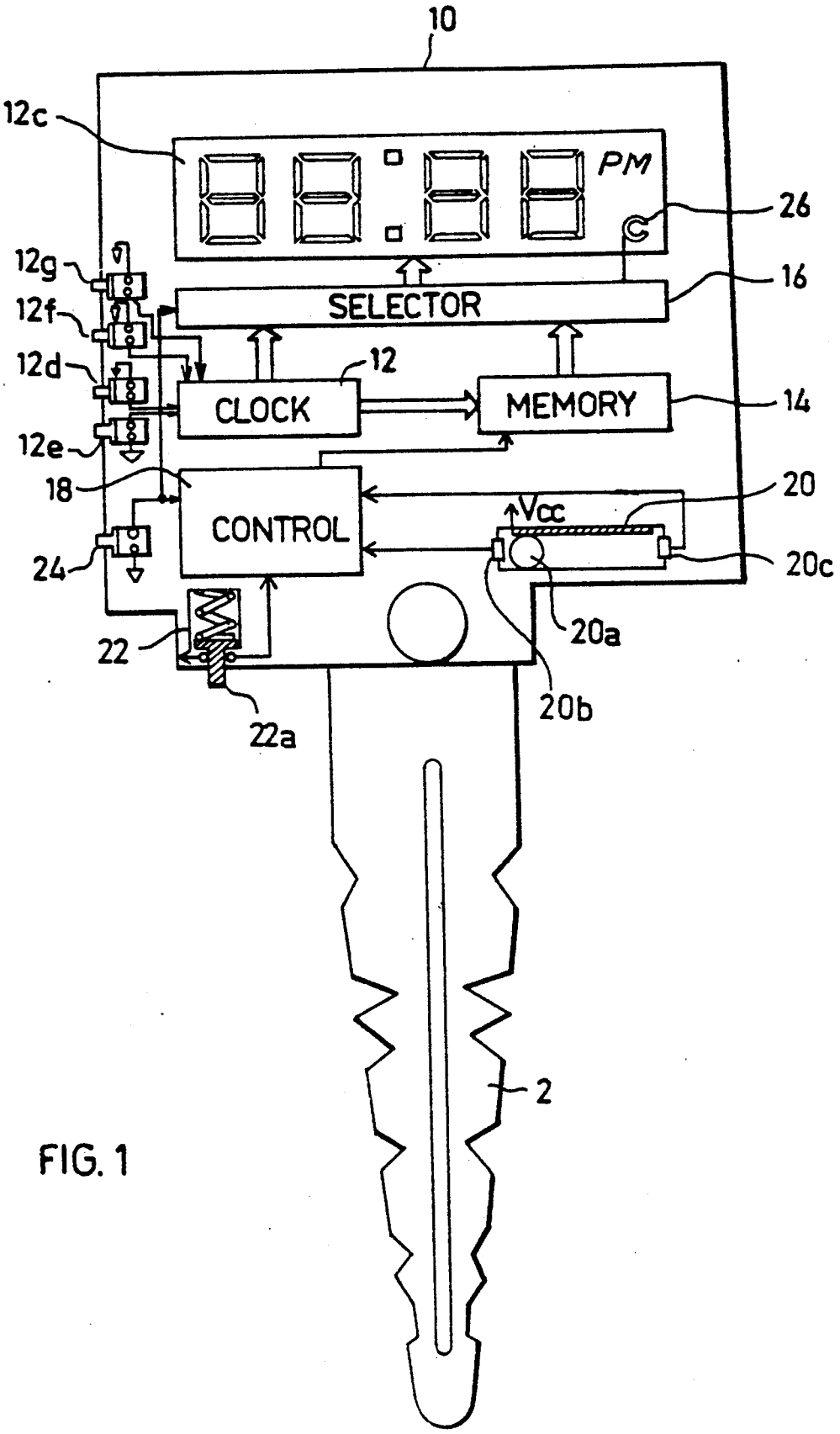
FIG. 1 illustrates one form of key construction in accordance with the present invention.
Figure 2:
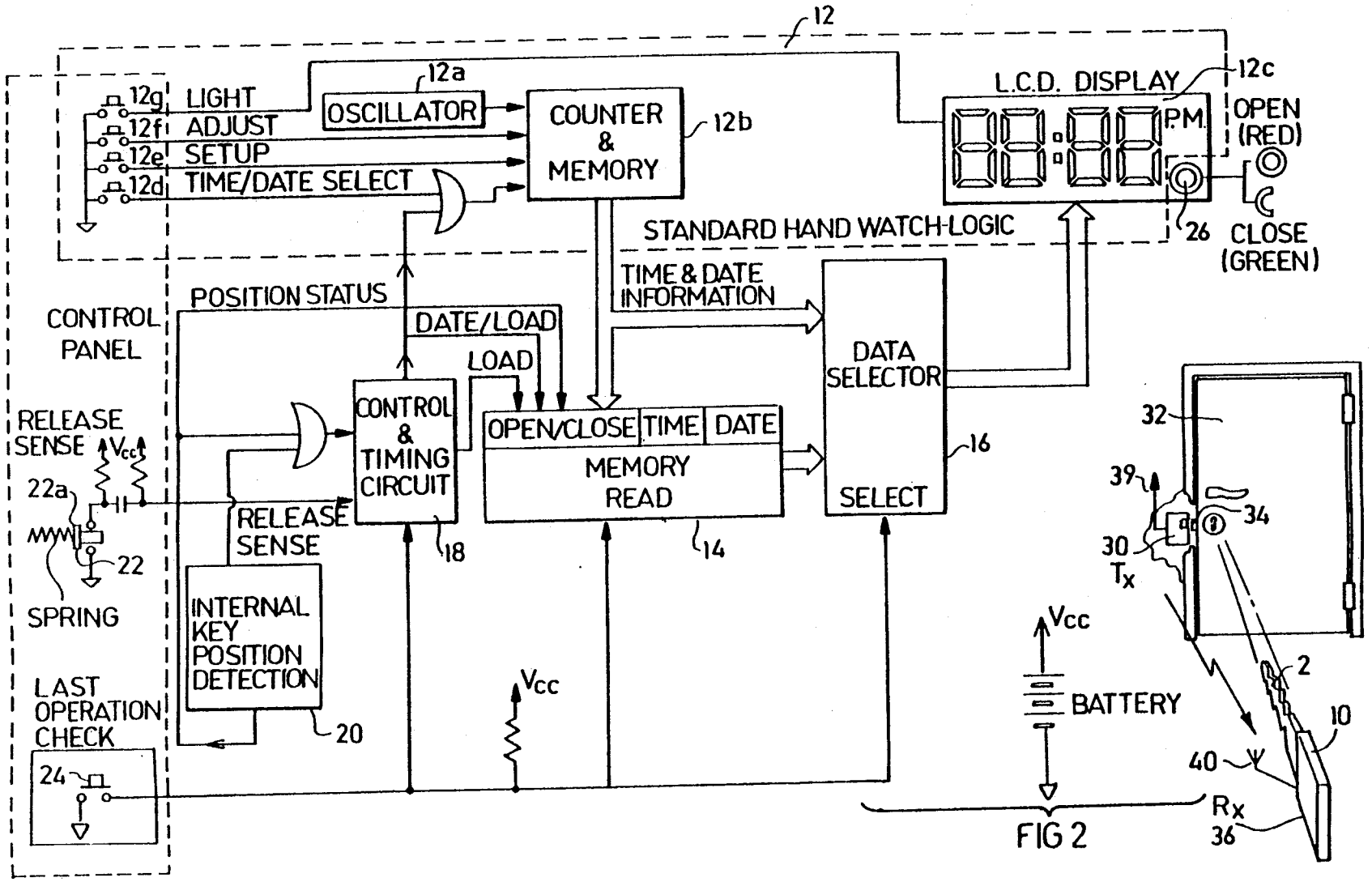
FIG. 2 is a block diagram illustrating the electrical circuit in the key of FIG. 1.

Embodiment of FIGS. 1 and 2

FIG. 1 illustrates a key, generally designated 2, incorporating one form of reminder apparatus in accordance with the present invention incorporated in the head 10 of the key, while FIG. 2 illustrates the electrical circuit of the reminder apparatus incorporated in the key head 10.

As shown in FIGS. 1 and 2, the reminder circuit incorporated in head 10 of the key includes a real time clock 12 which measures both the time of the day, and the day of the month. Any standard real time clock, such as widely used in digital watches and other timing devices, may be used for this purpose. FIG. 2 illustrates its main elements as including an oscillator 12*a*, a counter and memory 12*b*, and a display 12*c*. In addition, it may include a time/date select button 12*d*, a setup button 12*e*, an adjust button 12*f*, and a light button 12*g*, as known in digital clocks.

The reminder apparatus incorporated in the head 10 of the key illustrated in FIG. 1 further includes a memory 14, a data selector circuit 16, and a control circuit 18, all more particularly shown in the block diagram of FIG. 2.

The apparatus incorporated in head 10 of key 2 further includes an inclination-responsive switch 20, a release sensor switch 22, and a last-operation check switch 24. Inclination-responsive switch 20 is actuated to a first state when the key 2 is turned in one direction to open the lock, and to a second state when the key is turned in the opposite direction to close the lock. Such inclination-responsive switches are known and usually include a ball, as shown at 20*a* in FIG. 1, which is rollable to engage contact 20*b* at one end of the switch to close the electrical circuit, or another member 20*c* at the opposite end to open the electrical circuit. A mercury switch may also be used for this purpose.

Switch 22 is a micro-switch including a spring-urged operator 22*a* projecting through the head 10 of the key so as to be actuated to a first state when the key is inserted into the keyhole of the lock, and to a second state when the key is withdrawn from the keyhole of the lock. Switch 22 is used for sensing that the key has been inserted into the lock and withdrawn, and is effective to store the position of the key (i.e., its locking position or its unlocking position), as indicated by the inclination-responsive switch 20 at the time of removal of the key from the lock.

Switch 24 is also a micro-switch. This switch is manually depressed by the user whenever the user wishes to be informed of the time and nature of the last operation of the key, i.e., whether it was used to lock or unlock the door. The specific operation is indicated by an indicator lamp 26, also carried by head 10 of the key. Indicator lamp 26 is energized to display a "C" if the last operation was a closing operation, and a "O" if it was an opening operation.

The operation of the reminder apparatus illustrated in FIG. 1 will now be described particularly with reference to the block diagram illustrated in FIG. 2.

Each time the key 2 is used, micro-switch 22 is actuated when the key is inserted into the lock, and released when the key is withdrawn. At the time of withdrawal of the key, the position of the inclination-responsive switch 20 is inputted into the memory 14 by the control circuit 18, so that the nature of the last operation performed by using the key (i.e., whether a closing or an opening operation) is recorded in memory 14. Also recorded in memory 14 is the time of day and the day of the month as measured by the real time clock 12, this information being fed into memory 14 by control circuit 18.

The real time clock 12 continuously measures time, which time is displayed in the display 12*c* in the normal manner as in conventional digital watch. Whenever the user wishes to be informed of the last time the key was used, and the nature of the operation performed by the use of the key, the user depresses switch 24. This causes the display 12*c* to display, instead of the real time from clock 12, the time and date alternately of the last key operation as recorded in memory 14. Indicator 26 also displays the nature of the last key operation in which the key was used with respect to the lock; that is, if the last operation was to close the lock, then indicator 26 displays a "C", and if the last operation was to open the lock, the indicator displays a "O".

While it is preferred to incorporate the reminder circuitry of FIG. 2 in the head of the key, as illustrated in FIG. 1, it is also contemplated to incorporate this circuitry in a key holder to be carried by the user with the key.

Figure 3:
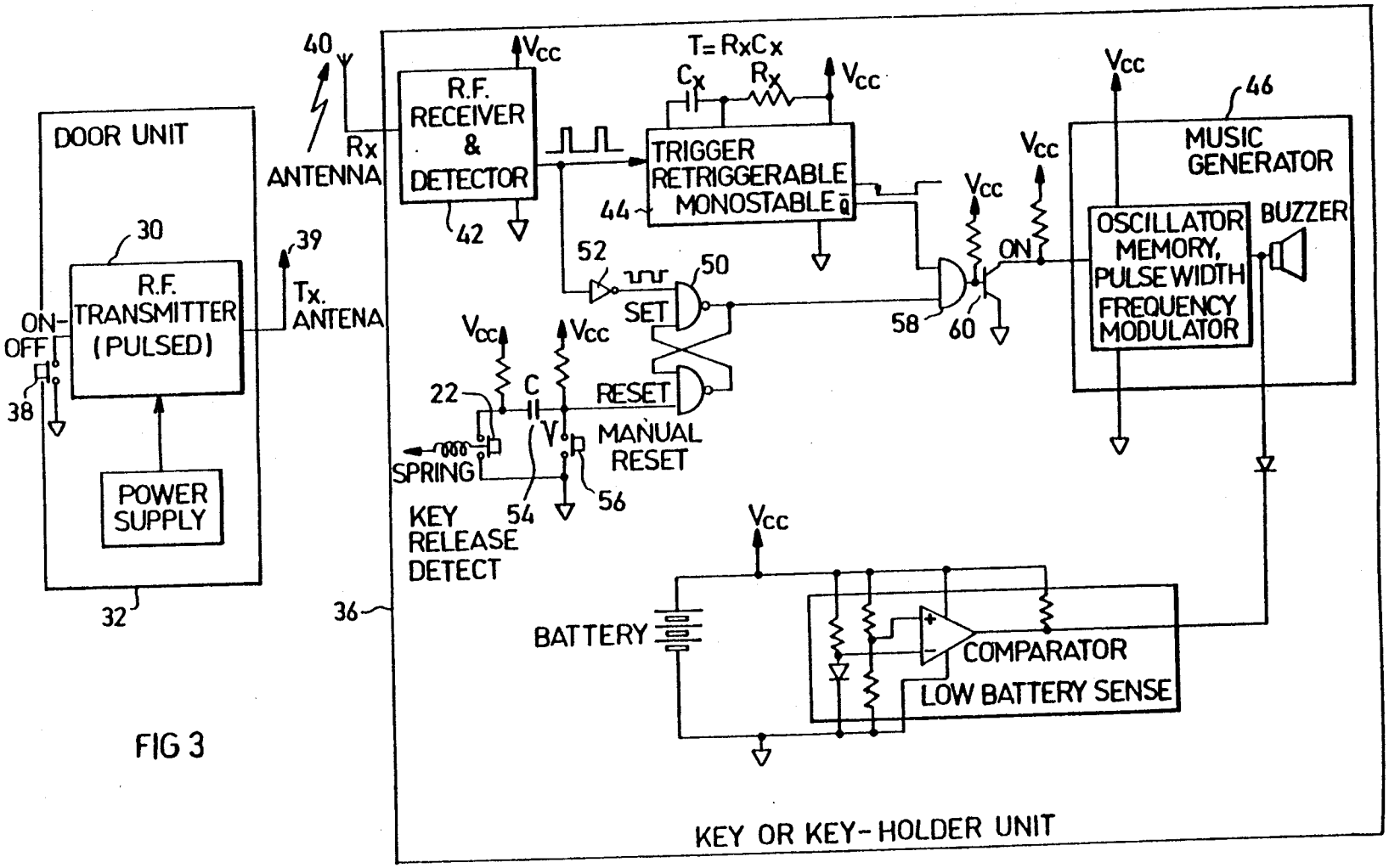
FIG. 3 is a block diagram illustrating another reminder circuit which could be used with, or without, the key and circuit of FIGS. 1 and 2.

Option of FIGS. 2 and 3

Sometimes a user may intentionally leave the door unlocked while in the immediate vicinity (e.g., in the house or working in the yard), but forgets to lock the door when leaving the immediate vicinitY of the house. FIG. 2 illustrates an arrangement which may be included as an option to the system of FIGS. 1 and 2, in order to alert the user whenever the door is unlocked and the user has moved a predetermined distance away from it; and FIG. 3 illustrates one way of implementing the above option of FIG. 2.

Thus, as shown in FIG. 2, a transmitter unit 30 is provided in the vicinity of the door 32 containing the lock 34 (FIG. 2) to be locked or unlocked by the use of the key 2. Transmitter 30 transmits a signal whenever the door is not in its locked condition. A receiver 36 is provided to receive the signal transmitted by the transmitter 30. Receiver 36 is carried with the key 2, for example by being included in the key head 10 or in a separate key holder used for holding the key 2. Receiver unit 36 includes, not only a receiver for receiving the signal from the transmitter 30, but also an audible signalling device, together with an actuator circuit for actuating the audible signalling device when (1) the door 32 is not in its locked condition, and (2) the receiver unit 36 is located more than a predetermined distance from the transmitter unit 30.

FIG. 3 more particularly illustrates the transmitter unit 30 in the immediate vicinity of the door 32, and the receiver unit 36 carried by the user with the key 2 for opening and closing the door.

The transmitter unit 30 includes an electrical switch 38 which is closed whenever the lock 34 (FIG. 2) of the door 32 is in its locked condition, to cause transmitter 30 to transmit periodic pulses via an antenna 39.

The receiver unit 36, carried by the user with the key, includes an antenna 40 receiving the transmitted pulses, and a receiver and detector 42 which detects the transmitted pulses. These transmitted pulses are inputted into a retriggerable monostable 44 which, so long as such pulses are received by the receiver 42, is effected to disable an audible signalling device, generally designated 46; thus, no audible signal is produced so long as the user is in the immediate vicinity of the unlocked door.

The receiver 36 carried by the user with the key also includes circuitry for disabling the audible signalling generator 46 whenever the last operation performed by the use of the key was to lock the door, even though the user moves away from the door greater than the mentioned predetermined distance. However, if the last operation performed by the user was to unlock the door, and the user moves away from the door a distance greater than the predetermined distance, then the audible signalling device 46 is actuated to alert the user to this situation. The circuitry for accomplishing the foregoing is illustrated in FIG. 3.

Circuit of FIG. 3

Thus, the receiver unit 36 includes a flip-flop 50 which has a "set" input from the receiver and detector unit 42 via an inverter 52, and a "reset" input from a capacitor 54 whose charge is controlled by the release-sense switch 22 in the key head 10 (FIG. 1). The circuitry to the "reset" input of flip-flop 50 also includes a Manual Reset Button 56 allowing the user to stop the audible alarm. Flip-flop 50 is of the type such that it changes state only if it receives a "low" signal in either of its inputs; otherwise, ir retains the same state.

The output of flip-flop 50 is received as one input of an AND-gate 58, having a second input received from the retriggerable monostable 44. When both of the latter inputs to AND-gate 58 are "high", it switches a transistor 60 so as to actuate the audible signalling device 46; at all other times, gate 58 produces a "low" output, which is ineffective to actuate the audible signalling device 46.

The system illustrated in FIG. 3 operates in the following manner according to any one of the following three possible conditions:

1. Door Unlocked and User Close-By

When the door is unlocked, and the user is close-by, the transmitter 30 transmits periodic pulses and the receiver 42, being close-by, receives these pulses. So long as the pulses are received, retriggerable monostaple 44 produces a "low" output, which low output is applied to AND-gate 52, thereby disabling the audible signalling device 46.

At this time, flip-flop 50 receives at its "set" input the inverted pulses from receiver 42 and inverter 52, which causes it to produce a "high" output to the AND-gate 58. However, since the other input to that gate is "low", the audible signalling device 46 is disabled as described above irrespective of this condition of the flip-flop.

Accordingly, when the door is unlocked and the user is close-by, the audible signalling device 46 will not be actuated.

2. Door Unlocked and User Far Away

When the door is unlocked, transmitter 30 will transmit periodic pulses as described above, but these pulses will not be received by the receiver for the two because of the distance between the user and the door. Accordingly, the retriggerable monostable 44 will produce a "high" output to AND-gate 58.

Since receiver 42 does not receive pulses, the output of inverter 52 will be "high". Since flip-flop 50 requires a "low" signal on either of its inputs in order to change state, the previous "high" output state of the flip-flop will remain, and therefore a "high" signal will be applied to the second input to AND-gate 58. Since both inputs to gate 58 are now "high", this will energize transistor 60 to actuate the audible signalling device 46.

Accordingly, in this situation wherein the door is unlocked and the user is far away, the audible signalling device 46 will be actuated so as to alert the user to this situation.

3. Door Locked

When the door is locked, transmitter 30 does not transmit, and therefore the output of receiver 42 will be low, whereas the output of the retriggerable monostable 44 will be high. However, the key release detector button 22 which applied a low signal to the "reset" input of flip-flop 50, thereby switching its output to a low state. This low state applied to AND-gate 58 disables the audible signalling device 46 from being actuated.

Accordingly, whenever the door has been locked, the audible signalling device 46 is disabled irrespective of the location of the user with respect to the door.

Figure 4:
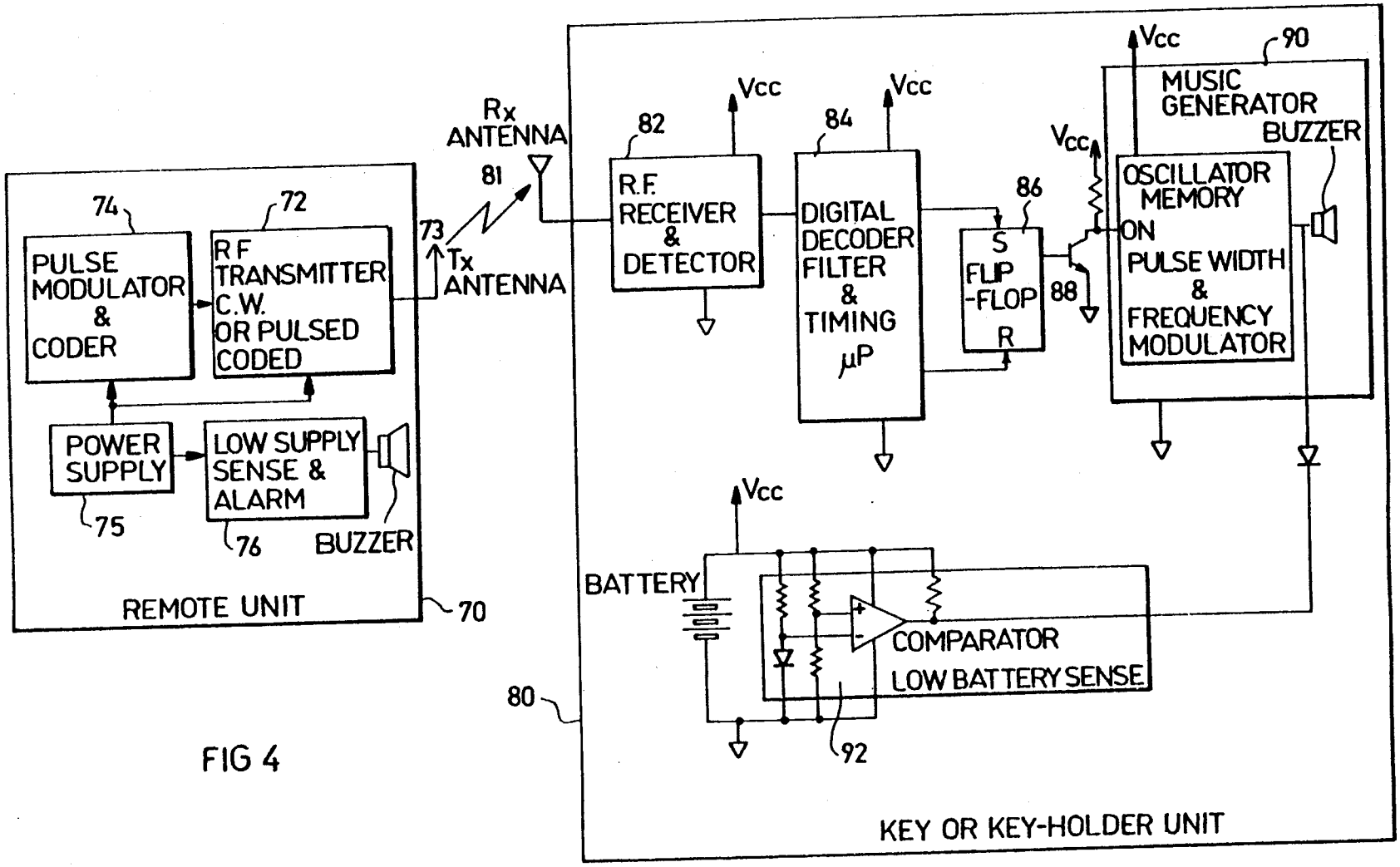
FIG. 4 is a block diagram illustrating another reminder system in accordance with the present invention.

Embodiment of FIG. 4

FIG. 4 illustrates another application of the system of FIG. 3, to alert a person guarding or carrying a portable object, such as a briefcase containing valuables, whenever the person moves away a predetermined distance from the object being guarded. As in the arrangement illustrated in FIG. 3, the system of FIG. 4 includes a transmitter unit, generally designated 70, to be located adjacent the object to be guarded, or incorporated within it (e.g., a briefcase); whereas the user carries a receiver unit, generally designated 80, e.g., on a key holder, carried by the user.

Transmitter unit 70 includes a transmitter 72 transmitting via an antenna 73 coded signals, as controlled by a pulse modulator and coder unit 74, to identify the particular receiver unit 80 to receive the transmitted signals. Transmitter unit 70 further includes a conventional power supply 75 and a low-supply indicator or alarm 76.

Receiver unit 80 carried by the user includes an antenna 81 receiving the transmitted signals, a receiver and detector unit 82, and a micro- processor which includes a digital decoder filter so as to receive only the coded signals from its respective transmitter 70. Microprocessor 84 controls a flip-flop which in turn controls a transistor 88 to actuate an audible signalling device 90. The receiver unit 80 further includes a conventional battery supply and battery-condition indicator circuit schematically indicated at 92.

The system illustrated in FIG. 4 operates as follows:

The transmitter unit 70 is included in the vicinity of the object to be guarded; for example, it could be incorporated in a briefcase containing valuables to be guarded Its transmitter 72 continuously transmits coded signals identifying a particular receiver unit 80, over a relatively short range.

The receiver unit 80 is carried by the user and, so long as the user is within the range of the transmitter unit 70, the received signals are processed by microprocessor 84 and flip-flop 86 to disable the audible signalling device 90 in a manner similar to that described above with respect to FIG. 3. However, whenever the user moves past the predetermined range of the transmitter, the receiver 82 will not receive the transmitted signals, whereby microprocessor 84 and flip-flop 86 will energize transistor 88 to actuate the audible signalling device 90, in a similar manner as described with respect to FIG. 3.

While the invention has been described with respect to several preferred embodiments, it will be appreciated that many other variations, modifications and applications of the invention may be made.

What is claimed is:

1. Reminder apparatus to be carried by a user with a key to remind the user as to the last operation in which the key was used with respect to a lock, comprising:

a real time clock for measuring time;

an operation sensor for sensing the time of the last key operation in which the key was used with respect to the lock;

a memory for storing the time of the last key operation as sensed by the sensor;

a display;

a manually-operable member; and a control circuit effective, upon manual operation of said latter member, to display in said display the time of the last key operation as stored in said memory.

2. The apparatus according to claim 1, wherein: said operation sensor also senses whether the last key operation was a lock-closing operation or a lock-opening operation; said memory also storing information indicating whether said last key operation was a lock-closing operation or a lock-opening operation; and said display also displaying an indication of whether said last key operation was a lock-closing operation or a lock-opening operation.

3. The apparatus according to claim 2, wherein said display includes a digital numerical indicator for displaying the time at the last key operation and a light indicator for indicating whether the last key operation was a lock-closing or a lock-opening operation.

4. The apparatus according to claim 1, wherein said memory also stores the date of said last key operation, said display also displaying the date of said last key operation.

5. The apparatus according to claim 1, wherein said control circuit normally connects said display to said real time clock to display the time measured thereby, but is effective, upon manual operation of said manually-operable member, to connect said memory to said display for displaying the time of said last key operation stored in the memory.

6. The apparatus according to claim 1, wherein said apparatus is incorporated in the key to be carried by the user and to be used for locking and unlocking the lock.

7. The apparatus according to claim 6, wherein said operation sensor includes switching means carried by said key for sensing the last operation in which the key was used with respect to the lock.

8. The apparatus according to claim 7, wherein said switching means comprises an inclination-responsive switch carried by said key and actuated to a first state when the key is turned to open the lock, and to a second state when the key is turned to close the lock.

9. The apparatus according to claim 8, wherein said switching means further includes a micro-switch carried by said key and actuated to a first state when the key is inserted into the keyhole of the lock, and to a second state when the key is withdrawn from the keyhole of the lock, said control circuit being effective, when said micro-switch is actuated to said first state and then to said second state, to record in said memory the state of said inclination-responsive switch at the time the key iS withdrawn from the keyhole.

10. The apparatus according to claim 1, wherein said apparatus is incorporated in a key holder to be carried by the user with the key to be used for locking and unlocking the lock.

11. The apparatus according to claim 1, wherein said lock is on a door to be locked in the closed position, said apparatus further including a transmitter unit in the vicinity of said door transmitting a signal whenever the door is not in its locked condition; and a receiver unit to be carried with the key; said receiver unit including a receiver for receiving said signal from the transmitter, an audible signalling device, and an actuator circuit for actuating said audible signal device when the door is not in its locked condition, and said receiver unit is located more than a predetermined distance from said transmitter unit.

12. The apparatus according to claim 11, wherein said transmitter unit transmits periodic pulses when the door is not in the locked condition; said actuator circuit including a retriggerable monostable effective to disable said audible signalling device when the receiver receives said periodic pulses from the transmitter unit, and to enable said audible signalling device when the receiver ceases to receive said periodic pulses from the transmitter unit.

13. The apparatus according to claim 12, wherein said key includes switching means settable to one state when the key was inserted and removed from the locking device; said actuator circuit including a flip-flop effective to disable said audible signalling device when said switching means has been set to said first state.

14. Reminder apparatus comprising:

a transmitter unit adapted to be secured to a door having a lock and to transmit a signal;

a receiver unit adapted to be carried by person with a key to be used for locking and unlocking the lock, the receiver unit receiving said signal from the transmitter;

an audible signalling device;

a circuit means for actuating said audible signalling device when said receiver unit is located more than a predetermined distance from said transmitter;

said receiver unit including disabling means for disabling said audible signalling device when the door has been locked.

15. Apparatus according to claim 14, wherein said audible signalling device and said circuit means are carried by said receiver unit.

16. The apparatus according to claim 15, wherein said transmitter unit transmits a coded signal identifying a particular receiver unit; said receiver unit including a decoder decoding said coded signal, and a control circuit for disabling said audible signalling device whenever the receiver unit receives said coded signal, and for actuating said audible signalling device whenever the receiver unit ceases to receive said coded signal.

17. Apparatus according to claim 16, wherein said audible signalling device and said circuit means are carried by said transmitter unit located adjacent the door to be locked.

* * * * *